US007264035B2

(12) United States Patent
Rossato et al.

(10) Patent No.: US 7,264,035 B2
(45) Date of Patent: Sep. 4, 2007

(54) TEMPORARY WINDOW COVERING

(75) Inventors: Alejandro Rossato, Greensboro, NC (US); Cliff Birch, Summerfield, NC (US)

(73) Assignee: Newell Window Furnishing, Inc., Freeport, IL (US)

( * ) Notice: Subject to any disclaimer, the term of this patent is extended or adjusted under 35 U.S.C. 154(b) by 223 days.

(21) Appl. No.: 10/719,449

(22) Filed: Nov. 21, 2003

(65) Prior Publication Data

US 2004/0159409 A1 Aug. 19, 2004

Related U.S. Application Data

(60) Provisional application No. 60/428,020, filed on Nov. 21, 2002.

(51) Int. Cl.
*E06B 9/324* (2006.01)

(52) U.S. Cl. ..... 160/178.2; 160/173 R; 160/84.04

(58) Field of Classification Search ..... 160/84.04, 160/84.05, 84.01, 178.2, 178.1 R; 24/129 R, 24/130

See application file for complete search history.

(56) References Cited

U.S. PATENT DOCUMENTS

| | | | | |
|---|---|---|---|---|
| 794,728 | A * | 7/1905 | Minetti | 254/409 |
| 1,215,985 | A | 2/1917 | Plate | |
| 1,804,811 | A | 5/1931 | Rosel | |
| 1,808,636 | A * | 6/1931 | Chesney | 24/18 |
| 2,053,356 | A | 9/1936 | Wiener | 156/17 |
| 2,129,606 | A | 9/1938 | Nisenson | 156/17 |
| 2,132,991 | A | 10/1938 | Mintz | 156/17 |
| 2,172,657 | A | 9/1939 | Haase | 156/17 |
| 2,175,977 | A | 10/1939 | Stuber et al. | 156/17 |
| 2,314,461 | A | 3/1943 | Schaefer | 160/173 |
| 2,631,661 | A | 3/1953 | Nelson | 160/133 |
| 2,732,010 | A | 1/1956 | Griesser | 160/170 |
| 3,066,372 | A * | 12/1962 | Parker | 403/209 |
| 3,727,665 | A | 4/1973 | Debs | 160/178 C |
| 3,799,236 | A | 3/1974 | Debs | 160/178 C |
| 3,918,513 | A | 11/1975 | Englund et al. | 160/176 |
| 3,931,846 | A | 1/1976 | Zilver | 160/178 |
| 3,952,789 | A | 4/1976 | Marotto | 160/168 R |
| 4,039,020 | A | 8/1977 | Jacobson | 160/178 C |

(Continued)

OTHER PUBLICATIONS

International Search Report, International Application No. PCT/US03/37311, mailed Mar. 5, 2004.

*Primary Examiner*—Blair M. Johnson
(74) *Attorney, Agent, or Firm*—Marshall, Gerstein & Borun LLP

(57) ABSTRACT

The invention is directed to a temporary window covering that may include a pleated cover formed from a sheet of material having a plurality of horizontal creases extending across the width of the sheet thereby defining a plurality of pleats, a bottom rail attached to a bottommost pleat of the pleated cover, and a first lift cord having a first end connected to the bottom rail, with the first lift cord being threaded upwardly through holes of the pleats of the pleated cover. The temporary window covering may also include a first cord guide and a cord lock, both of which may be include a throughbore for slidably engaging the first lift cord when the first lift cord is disposed therein, and a slot for retentively engaging the first lift cord when the first lift cord is disposed therein to support the weight of the bottom rail and an accumulated portion of the pleated cover.

14 Claims, 13 Drawing Sheets

U.S. PATENT DOCUMENTS

| | | | | |
|---|---|---|---|---|
| 4,245,688 | A | 1/1981 | Vecchiarelli | 160/178 C |
| 4,250,597 | A * | 2/1981 | Ford et al. | 24/132 R |
| 4,327,797 | A | 5/1982 | Nakajima et al. | 160/168 R |
| 4,352,386 | A | 10/1982 | Butler et al. | 160/178 C |
| 4,476,909 | A | 10/1984 | Anderle et al. | 160/178 C |
| 4,487,243 | A | 12/1984 | Debs | 160/168 R |
| 4,488,588 | A | 12/1984 | McClure | 160/178 C |
| 4,647,488 | A | 3/1987 | Schnebly et al. | 428/116 |
| 4,722,383 | A | 2/1988 | Kross | 160/178 C |
| 4,945,970 | A | 8/1990 | Marocco | 160/178.2 |
| 5,143,135 | A | 9/1992 | Kuhar | 160/107 |
| 5,156,196 | A | 10/1992 | Corey et al. | 160/178.2 |
| 5,158,127 | A | 10/1992 | Schumacher | 160/84.1 |
| 5,285,838 | A | 2/1994 | Rapp et al. | 160/168.1 |
| 5,297,608 | A | 3/1994 | Rapp et al. | 160/177 |
| 5,316,066 | A | 5/1994 | Rapp et al. | 160/178.2 |
| 5,538,066 | A | 7/1996 | Liu | 160/173 |
| 5,623,982 | A | 4/1997 | Okazaki | 160/178.2 |
| 5,791,022 | A | 8/1998 | Bohman | 24/130 |
| 5,799,715 | A | 9/1998 | Biro et al. | 160/170 R |
| 6,131,640 | A | 10/2000 | Judkins | 160/168.1 R |
| 6,338,378 | B1 | 1/2002 | Kold | 160/279 |
| 6,443,207 | B1 | 9/2002 | Cheng et al. | 160/84.04 |
| 6,581,250 | B2 * | 6/2003 | Matsushima et al. | 24/130 |

* cited by examiner

TEMPORARY WINDOW COVERING

REFERENCE TO RELATED APPLICATIONS

This application claims priority from Provisional Application Ser. No. 60/428,020, filed on Nov. 21, 2002, which is expressly incorporated by reference herein.

BACKGROUND

The present invention is directed to window coverings, and more particularly to a temporary window covering that may be mounted proximate a window or other opening, and may be raised and lowered to selectively allow the passage of a desired amount of light.

Various temporary coverings have been previously described. For example, U.S. Pat. No. 5,158,127 to Schumacher discloses a temporary covering for a window or the like, including an elongated paper-like sheet having equidistant parallel pleats defined by creases extending across the sheet. An adhesive fastening strip is located at the top end of the sheet for fastening the sheet to a window, window frame, or the like. When mounted to a window or window frame, the temporary window covering extends downwardly to a selective variable length, while maintaining a pleated appearance.

SUMMARY OF THE INVENTION

In one aspect, the invention is directed to a temporary window covering that may include a pleated cover formed from a sheet of material having a top edge, a bottom edge and a plurality of horizontal creases extending across the width of the sheet thereby defining a plurality of pleats. Each pleat may have a first hole therethrough with the first holes being substantially aligned from the bottom edge to the top edge. The pleated cover may be adapted to be oriented in a retracted position wherein each of the pleats is substantially horizontally aligned and in contact with the adjacent pleats, an extended position wherein each of the pleats is substantially vertical and substantially vertically aligned with the other pleats, and a plurality of intermediate positions wherein at least some of the pleats are oriented between the pleats' retracted positions and the pleats' extended positions. The temporary window covering may further include a bottom rail attached to a bottommost pleat of the pleated cover, and a first lift cord having a first end connected to the bottom rail, with the first lift cord being threaded through the first holes of the pleats of the pleated cover.

The temporary window covering may also include a first cord guide coupled to the pleated cover proximate the top edge and proximate the first holes, and the first cord guide may have a first throughbore and a slot intersecting the first throughbore. The first throughbore of the first cord guide may be configured to slidably engage the first lift cord when the first lift cord is disposed therein, and the slot of the first cord guide may be configured to retentively engage the first lift cord to support the weight of the bottom rail and an accumulated portion of the pleated cover when the first lift cord is disposed therein. Moreover, the temporary window covering may include a cord lock coupled to the pleated cover proximate the top edge and having a first throughbore and a slot intersecting the first throughbore. The first throughbore of the cord lock may slidably engage the first lift cord when the first lift cord is disposed therein, and the slot of the cord lock may retentively engage the first lift cord to support the weight of the bottom rail and an accumulated portion of the pleated cover when the first lift cord is disposed therein.

The first lift cord may be thread through the first holes of the pleats of the pleated cover, through the first throughbore of the first cord guide, and through the first throughbore of the cord lock, and the temporary window covering may be adapted to be repositioned from a first one of the retracted position, the extended position and an intermediate position to a second one of the retracted position, the extended position and an intermediate position by moving a first portion of the first lift cord disposed in the slot of the cord lock to the first throughbore of the cord lock, sliding the first lift cord through the first throughbore of the first cord guide and the first throughbore of the cord lock, and moving a second portion of the first lift cord disposed in the first throughbore of the cord lock to the slot of the cord lock.

In another aspect, the invention is directed to a combined cord guide and cord lock for a temporary window shade having a pleated cover, a bottom rail coupled to the pleated cover proximate a bottom edge of the pleated cover, and at least one lift cord connect to the bottom rail, wherein the combined cord guide and cord lock may be coupled to the pleated cover. The combined cord guide and cord lock may include a body member having an outer surface, and a first inner surface intersecting a first portion of the outer surface and a second portion of the outer surface, and may define a first throughbore within the body member, with the first inner surface slidably engaging at least one lift cord of the temporary window covering disposed therein. The combined cord guide and cord lock may further include a second inner surface intersecting a third portion of the outer surface and the first inner surface, and may define a second throughbore within the body member, with the second inner surface slidably engaging at least one lift cord of the temporary window covering disposed therein. The combined cord guide and cord lock may also include a third inner surface intersecting a fourth portion of the outer surface and the second inner surface, and may define a slot within the body member, with the third inner surface engaging at least one lift cord of the temporary window covering disposed therein to support the weight of the bottom rail and an accumulated portion of the pleated cover of the temporary window shade.

In a further aspect, the invention is directed to a combined cord guide and cord lock for a temporary window shade having a pleated cover, a bottom rail coupled to the pleated cover proximate a bottom edge of the pleated cover, and at least one lift cord connect to the bottom rail, wherein the combined cord guide is coupled to the pleated cover. The combined cord guide and cord lock may include a body member having an outer surface, a first inner surface intersecting a first portion of the outer surface of the body member and defining a portion of a channel in the outer surface of the body member, a second inner surface intersecting a second portion of the outer surface and the first inner surface and defining a portion of a throughbore in the outer surface of the body member, and a third inner surface intersecting a third portion of the outer surface and the second inner surface and defining a slot in the outer surface of the body member. A portion of the pleated to which the combined cord guide and cord lock is coupled may define the remaining portions of the channel, the throughbore and the slot. The first inner surface may slidably engage at least one lift cord of the temporary window covering disposed therein, the second inner surface may slidably engage at least one lift cord of the temporary window covering disposed therein, and the third inner surface may engage at least one lift cord of the temporary window covering disposed therein to support the weight of the bottom rail and an accumulated portion of the pleated cover of the temporary window shade.

In a still further aspect, the invention is directed to a combined cord guide and cord lock for a temporary window shade having a pleated cover, a bottom rail coupled to the pleated cover proximate a bottom edge of the pleated cover, and at least one lift cord connect to the bottom rail, wherein the combined cord guide is coupled to the pleated cover. The combined cord guide and cord lock may include an upwardly extending first portion and an outwardly extending second portion connected to the first portion. The second portion may include a first inner surface defining a through-bore within the second portion, with the first inner surface slidably engaging at least one lift cord of the temporary window covering disposed therein, and a second inner surface defining a slot within the second portion, with the second inner surface engaging at least one lift cord of the temporary window covering disposed therein to support the weight of the bottom rail and an accumulated portion of the pleated cover of the temporary window shade.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
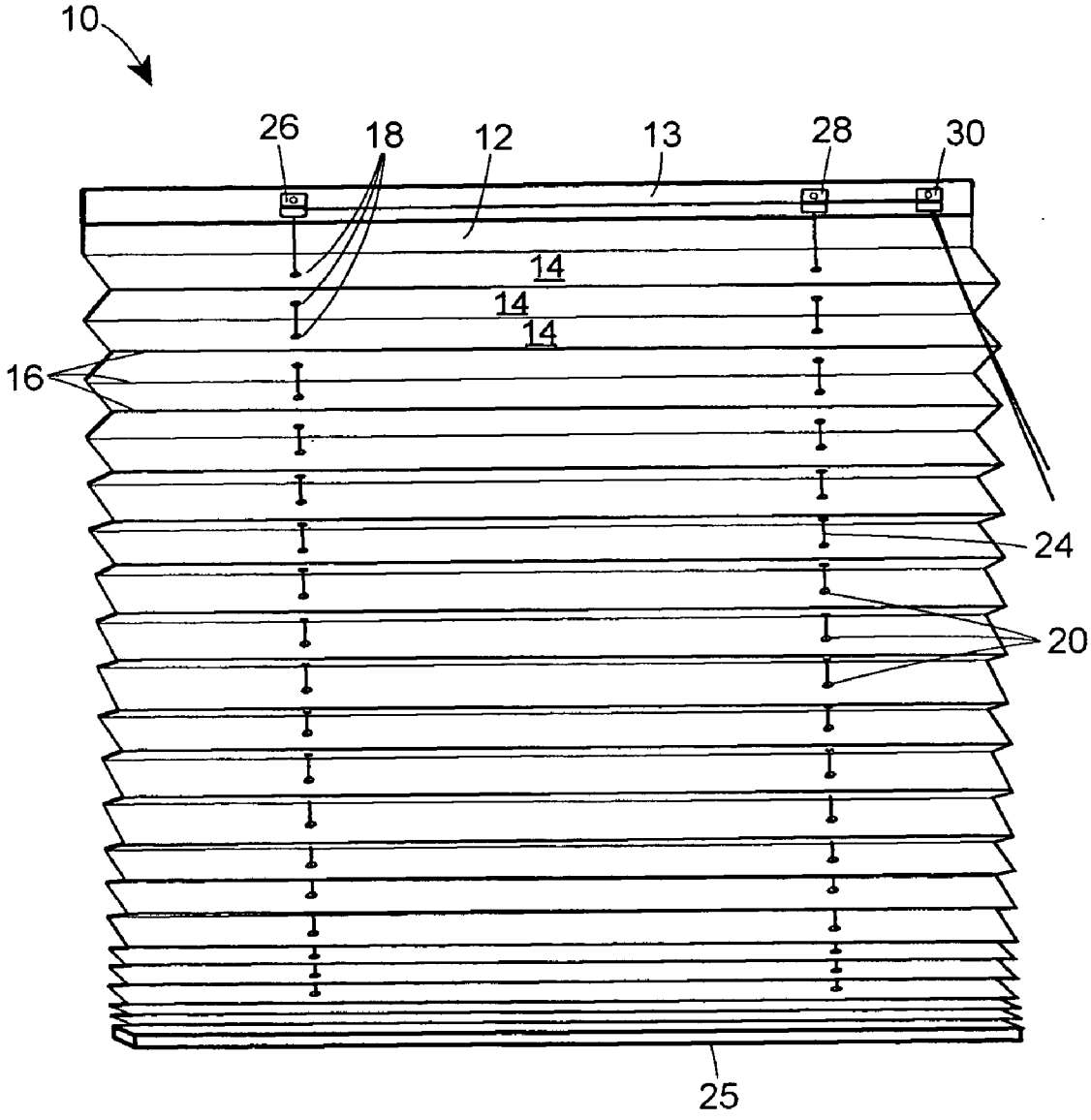
FIG. 1 is a front view of an embodiment of a temporary window covering.

FIG. 1 illustrates one possible embodiment of a temporary window covering 10 in accordance with the invention. In the illustrated embodiment, the window covering 10 includes a pleated cover 12 attached to a headrail 13 having a plurality of horizontal pleats 14 defined by a plurality of horizontal creases 16 extending across the entire width of the pleated cover 12. Configured in this way, the pleated cover 12 may assume a completely retracted position wherein each of the pleats 14 is substantially horizontal and in contact with the adjacent pleats 14, or a completely extended position wherein each of the pleats 14 is substantially vertical and substantially vertically aligned with the other pleats 14. Moreover, the pleated cover 12 may assume intermediate positions wherein some or all of the pleats 14 are oriented between their compressed positions and their fully extended positions. The pleated cover 12 may be formed from a sheet of paper, vinyl, textile, film, fabric, laminate or other suitable material known to those skilled in the art. Moreover, the material may also have a character and thickness making the pleated cover 12 cuttable so that the window covering 10 may be sized by the consumer to fit the covered opening.

Each of the pleats 14 of the pleated cover 12 includes a pair of holes 18, 20 passing therethrough, each being approximately equidistant from the sides of the pleated cover 12. The holes 18, 20 through the pleats 14 are positioned between the crease 16 defining the corresponding pleats 14 by a consistent distance such that the holes 18, 20 are substantially vertically aligned when the pleated cover 12 is in the fully retracted position. Cords 22, 24 pass through the holes 18, 20 respectively, with each cord 22, 24 having its lower end attached to a bottom rail 25 at the bottom of the pleated cover 12 and its upper end extending upwardly through cord guides 26, 28, respectively, attached to the headrail 13. The upper ends of the cords 22, 24 are also threaded downwardly through an opening in a cord lock 30 disposed proximate the right edge of the window covering 10.

The window covering 10 may be installed to cover an opening by attaching the headrail 13 proximate the top of the opening. The headrail 13 may be attached directly to the frame, casement, wall or other structure that at least partially defines the upper boundary of the opening to be covered by the window covering 10. The attachment of the top end of the pleated cover may be achieved by an adhesive or an adhesive strip between the headrail 13 and the surface to which the window covering 10 is attached, or by any other temporary fastener or attachment mechanism in a manner that will be readily apparent to those skilled in the art.

Once installed, the window covering 10 may be adjusted to any desired position by unlocking the cords 22, 24 from the cord lock 30 in a manner described more fully below, and releasing or pulling downwardly on the cords 22, 24 until the bottom rail 25 is in the desired position. When the bottom rail 25 is set to the desired position, the cords 22, 24 are relocked in the cord lock 30 in a manner described more fully below. When the user wishes to readjust the pleated cover 12, cords 22, 24 are again unlocked from the cord lock 30 to allow the user to reposition the bottom rail 25 to the desired position. Once the pleated cover 12 is repositioned, cored 22, 24 are again locked in place by the cord lock 30.

Figure 2:
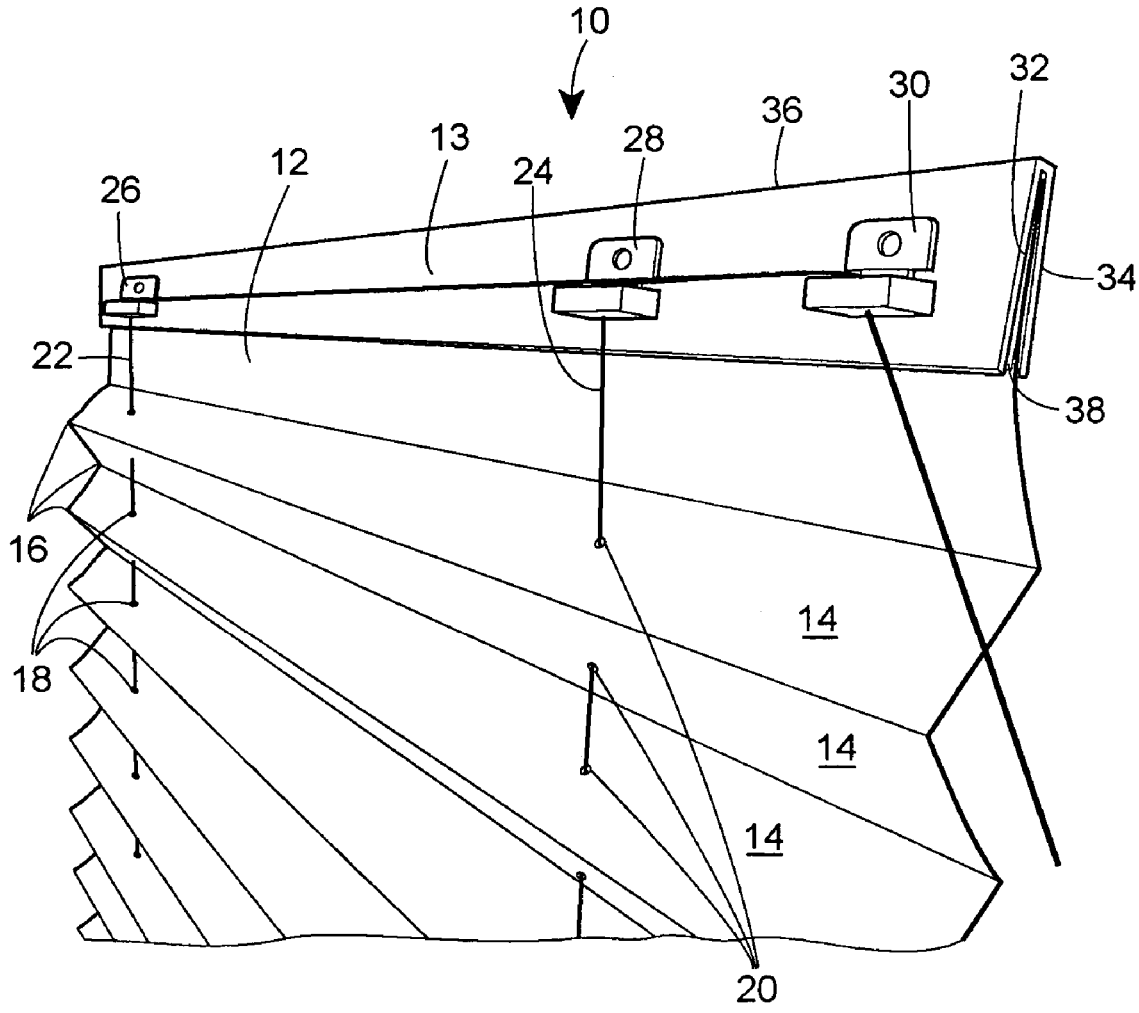
FIG. 2 is a side perspective view of the temporary window covering of FIG. 1.

Referring now to FIG. 2, the headrail 13 may be fabricated from any elongated strip of cardboard, plastic or other semi-rigid but bendable material, with the elongated strip having a longitudinal crease along which the strip is folded to form a front side 32 and rear side 34 having a common top edge 36. As with the pleated cover 12, the material from which the headrail 13 is fabricated may have a character and thickness making the headrail 13 cuttable and the window covering 12 may accommodate openings of varying sizes. The cord guides 26, 28 and cord lock 30 are attached to the outer surface of the front side 32 by an adhesive or other attachment mechanism. The pleated cover 12 is attached to the headrail 13 by adhesive layers on the inner surfaces of one or both of the front and rear sides 32, 34 of the headrail 13 engaging a topmost pleat 38 of the pleated cover 12. The rear side 34 of the headrail 13 may also have an adhesive layer disposed on the outer surface for attaching the headrail 13 to the surface to which the window covering 10 is attached.

Figure 3:
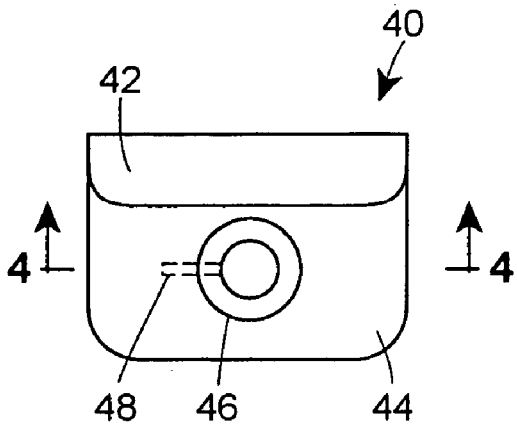
FIG. 3 is a top view of an embodiment of a combination cord guide and cord lock.
Figure 4:
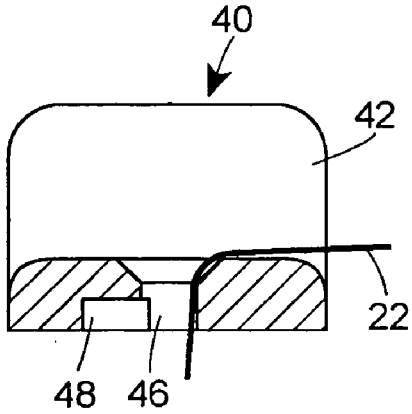
FIG. 4 is a front cross-sectional view through line 4-4 of the combination cord guide and cord lock of FIG. 3 used as a cord guide.
Figure 5:
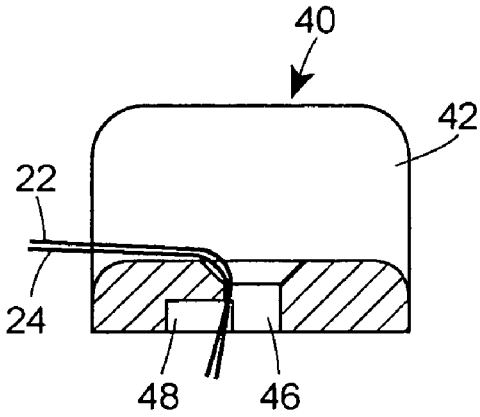
FIG. 5 is a front cross-sectional view through line 4-4 of the combination cord guide and cord lock of FIG. 3 used as a cord lock.

FIGS. 3-5 illustrate an embodiment of a combination cord guide and cord lock 40 that may be used in the window covering 10. Referring to FIG. 3, the combined cord guide and cord lock 40 includes an upwardly extending portion 42 that is attached to the outer surface of the front side 32 of the headrail 13, and an outwardly extending portion 44 having a countersunk opening 46 therethrough. The outwardly extending portion 44 further includes a slot 48 extending upwardly through the bottom of the outwardly extending portion 44, and intersecting the opening 46 such that the cords 26, 28 passing through the opening 46 may be disposed within and engaged by the slot 48. The opening 46 through the outwardly extending portion 44 is dimensioned sufficiently large so that the cords 22, 24 may pass freely through the opening 46 when the cords 22, 24 are disposed therein. The slot 48 is dimensioned such that the cords 22, 24 are engaged by the slot 48 when the cords 22, 24 are disposed therein to prevent the cords 22, 24 from sliding within the slot 48 under the weight of the bottom rail 25 and accumulated portion of the pleated cover 12 supported by the cords 22, 24 and slot 48.

Configured in this way, the combined cord guide and cord lock 40 may be used for both the cord guides 26, 28 and the cord lock 30 of the window covering 10. Referring now to FIG. 4, the combined cord guide and cord lock 40 is implemented as the cord guide 26. The upper end of the cord 22 is threaded upwardly through the opening 46 and rightwardly toward the cord lock 30. Because the cord 22 is disposed on the right side of the opening 46, the cord 22 is not engaged by the slot 48 and, consequently, is free to pass through the opening as the window covering 10 is raised and lowered. Referring to FIG. 5, the combined cord guide and cord lock 40 is implemented as the cord guide 30. The upper ends of the cords 22, 24 are threaded downwardly through the opening 46 and are pulled to the left in the figure into the slot 48 wherein the cords 22, 24 are engaged by the slot 48 to hold the pleated cover 12 in the desired position. In order to reposition the window covering 10, the free ends of the cords 22, 24 are pulled to the right out of slot 48 so that the cords 22, 24 are free to move within the opening 46 to adjust the window covering 10 to the desired position.

Figure 6:
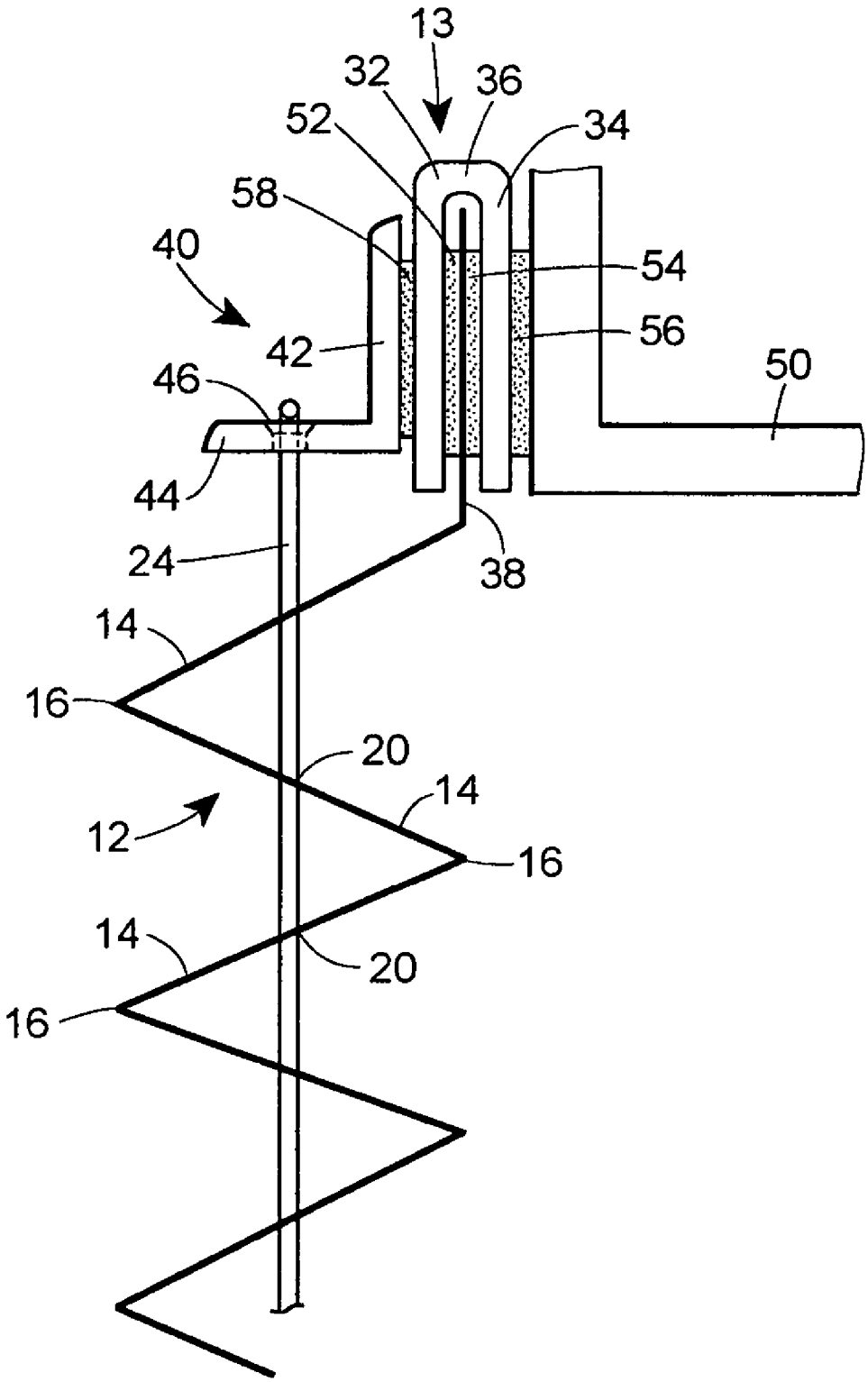
FIG. 6 is a side view of the temporary window covering of FIG. 1 installed to cover an opening.

Referring now to FIG. 6, the window covering 10 is illustrated attached to an upper part of a window frame 50, or other support structure. As shown, the inner surfaces of the front and rear sides 32, 34 of the headrail 13 include adhesive layers 52, 54, respectively, disposed thereon, with the adhesive layers 52, 54 attaching the top most pleat 38 to the headrail 13. The outer surface of the rear side 34 of the headrail 13 has an adhesive layer 56 disposed thereon to connect the headrail 13 to the window frame 50. A fourth adhesive layer 58 is disposed between the outer surface of the front side 32 and the combined cord guide and cord lock 40 to connect the two components.

Figure 7:
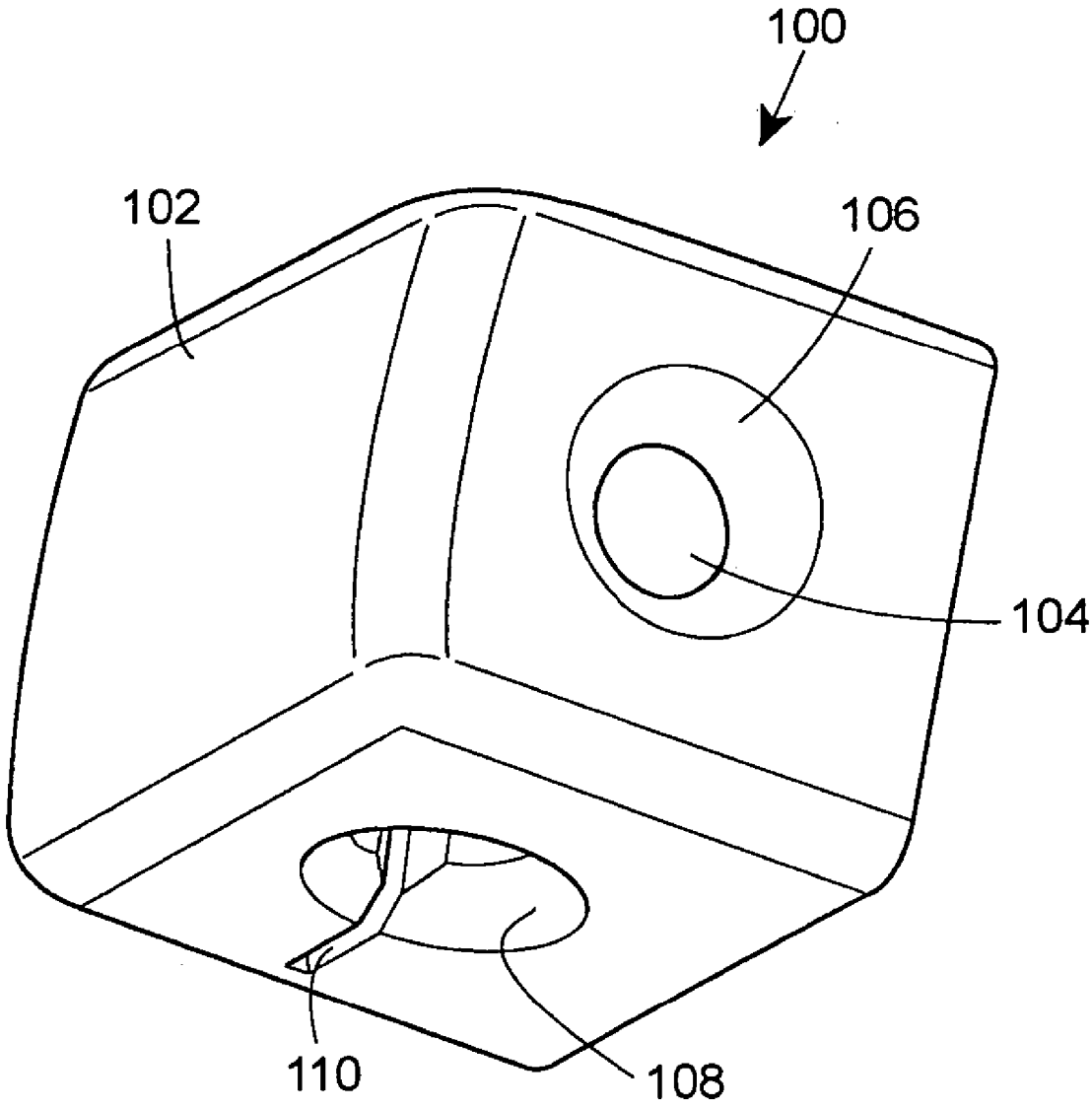
FIG. 7 is a bottom right side perspective view of an alternative embodiment of a combination cord guide and cord lock.
Figure 8:
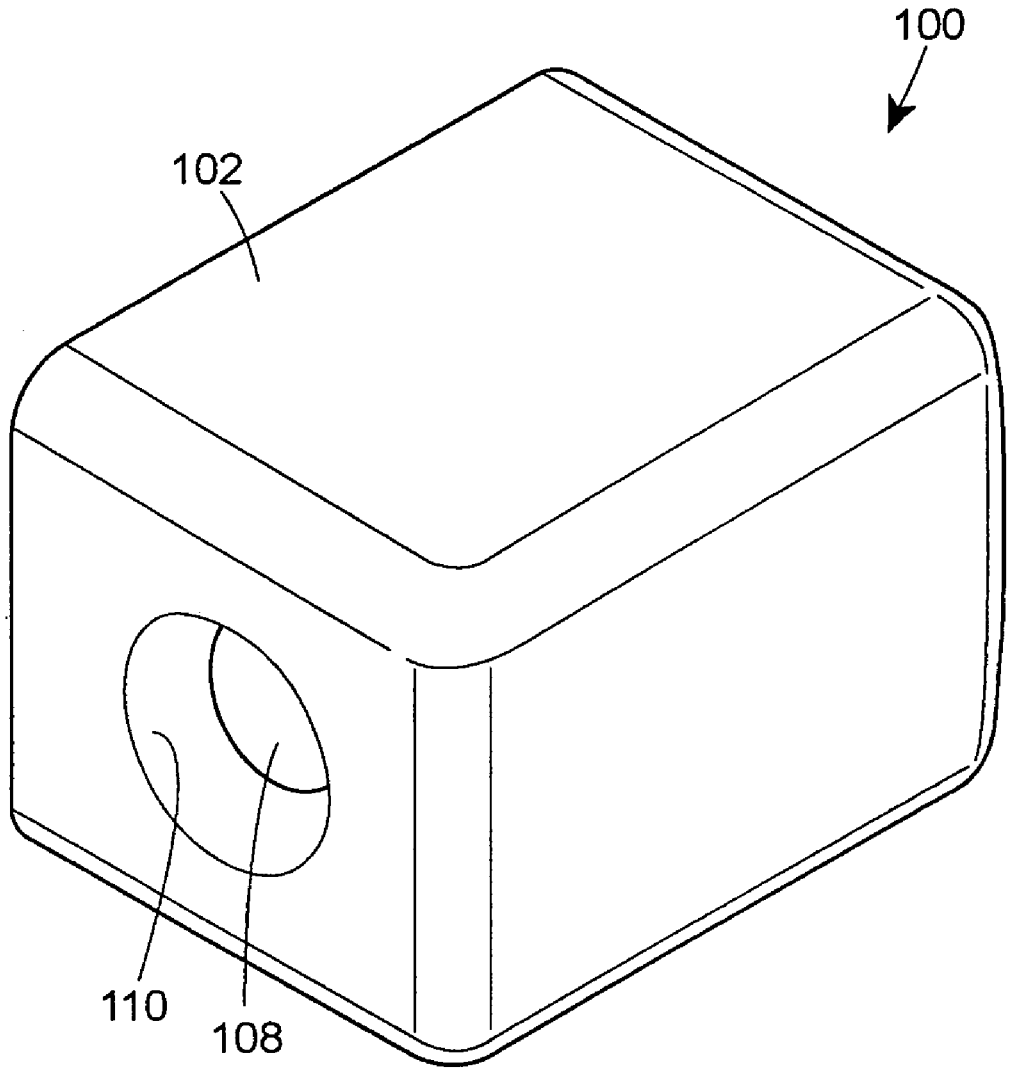
FIG. 8 is a top left side perspective view of the combination cord guide and cord lock of FIG. 7.

Referring now to FIGS. 7-11, an alternative embodiment of a combination cord guide and cord lock 100 is illustrated. FIG. 7 is a perspective view of the combined cord guide and cord lock 100. The combined cord guide and cord lock 100 includes a cubic block of material having a throughbore connecting a left countersunk opening (not shown) with a right countersunk opening 106. A third countersunk opening 108 is disposed in the bottom of the block 102 and extends upwardly to intersect the throughbore 104. The block 102 further includes a slot 110 extending upwardly from the bottom surface of the block 102 and intersecting the third opening 108 so that cords passing through the opening 108 may be pulled into the slot 110. FIG. 8 is a further perspective view showing the left and top sides of the block 102. As is shown, the left countersunk 112 intersects the throughbore 104 to connect the opening 112 and the opening 106. The openings 106, 112 and the throughbore 104 are dimensioned sufficiently large so that the cords 22, 24 may pass freely through the throughbore 104 when the cords 22, 24 are disposed therein.

Figure 9:
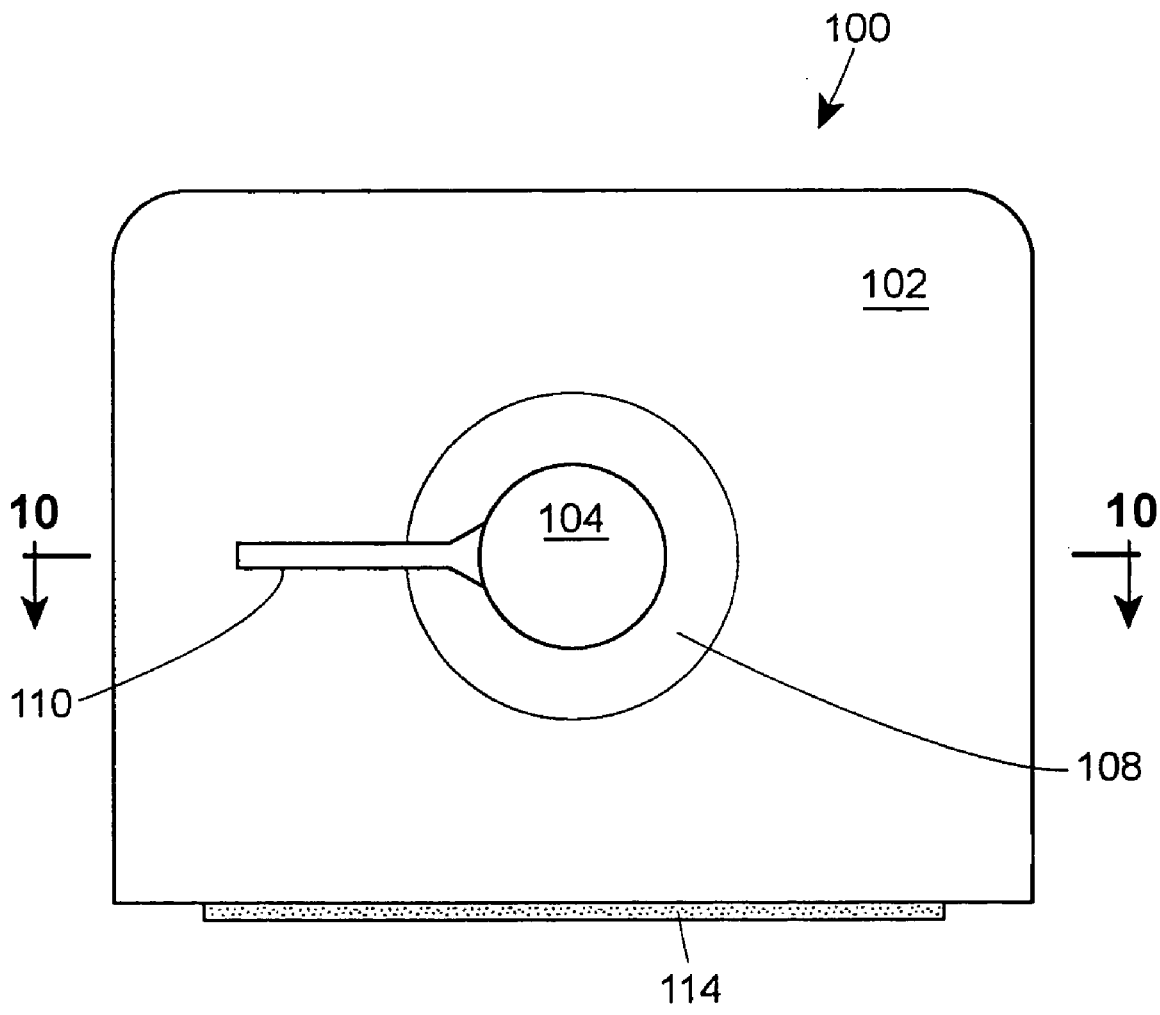
FIG. 9 is a bottom view of the combination cord guide and cord lock of FIG. 7.

FIG. 9 further illustrates the bottom side of the combined cord guide and cord lock 100. As shown, the opening 108 extends upwardly into the block 102 to intersect throughbore 104 so that a continuous passage is formed between the openings 106, 108 and 112. As with the throughbore 104 and the openings 106, 112, the opening 108 is dimensioned sufficiently large so that the cords 22, 24 may pass freely through the opening 108 when the cords 22, 24 are disposed therein. The slot 110 is dimensioned such that the cords 22, 24 are engaged by the slot 110 when the cords 22, 24 are disposed therein to prevent the cords 22, 24 from sliding within the slot 110 under the weight of the bottom rail 25 and accumulated portion of the pleated cover 12 supported by the cords 22, 24 and slot 110. FIG. 9 further illustrates that the rear surface of the block 102 may have an adhesive layer 114 disposed thereon, with the adhesive layer 114 being used to attach the combined cord guide and cord lock 100 to the outer surface of the front side 32 of the headrail 13.

Figure 10:
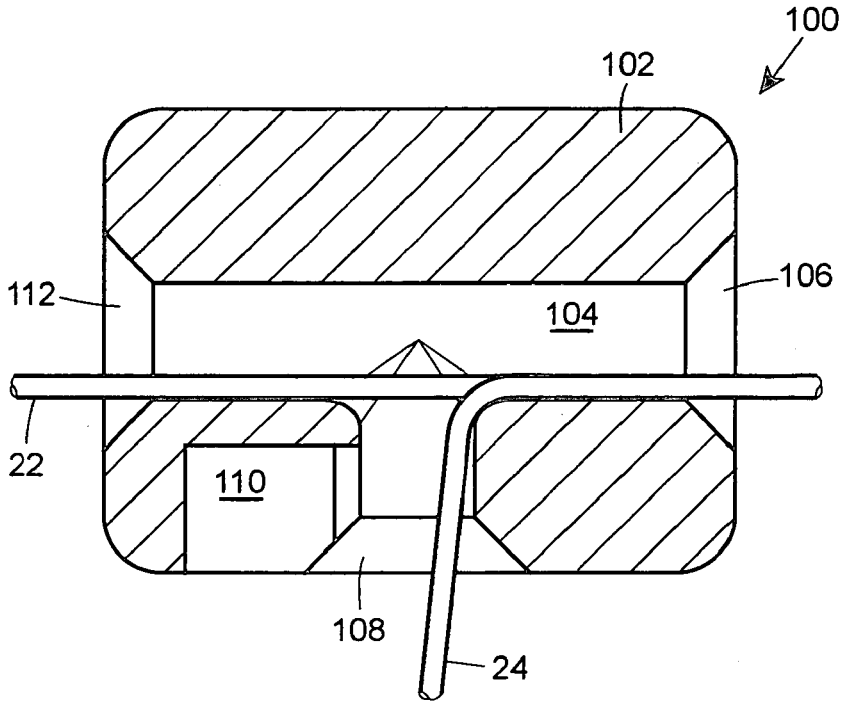
FIG. 10 is a front cross-sectional view through line 10-10 of the combination cord guide and cord lock of FIG. 7 used as a cord guide.
Figure 11:
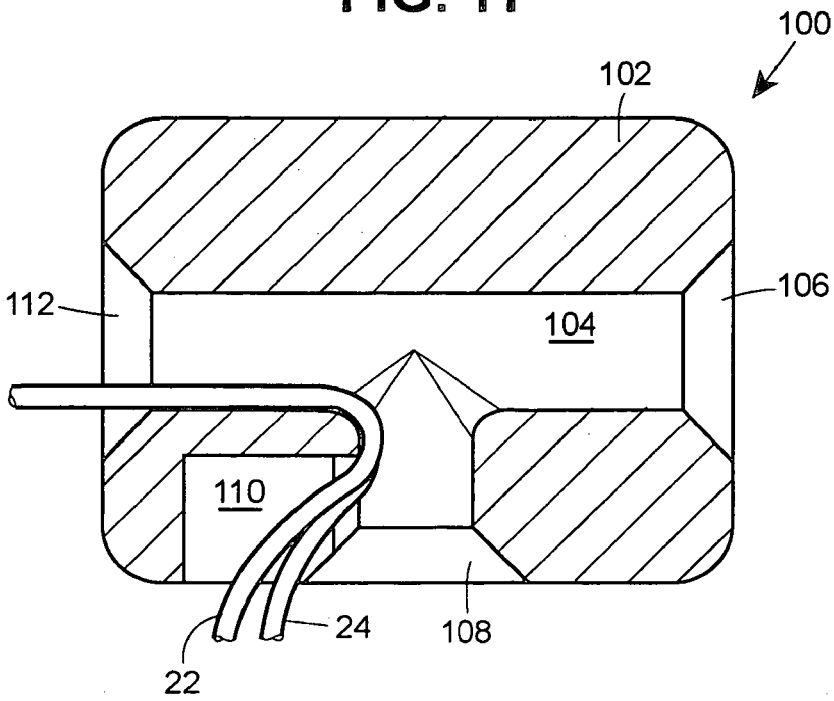
FIG. 11 is a front cross-sectional view of the combination cord guide and cord lock of FIG. 7 used as a cord lock.

Configured in this way, the combined cord guide and cord lock 100 may be used for both the cord guides 26, 28 and the cord lock 30 of the window covering 10. Referring now to FIG. 10, the combined cord guide and cord lock 100 is implemented as the cord guide 28. The upper end of the cord 24 is threaded upwardly through the opening 108 and rightwardly toward the cord lock 30 through the opening 106. Because the cord 24 is disposed on the right side of the opening 108, the cord 24 is not engaged by the slot 110 and, consequently, is free to pass through the opening as the window covering 10 is raised and lowered. As shown, the cord 22 may also pass through the throughbore 104 by being threaded through the openings 112, 106. Referring to FIG. 11, the combined cord guide and cord lock 100 is implemented as the cord guide 30. The upper ends of the cords 22, 24 are threaded through opening 112, downwardly through the opening 108, and pulled to the left in the figure into the slot 110 wherein the cords 22, 24 are engaged by the slot 110 to hold the pleated cover 12 in the desired position. In order to reposition the window covering 10, the free ends of the cords 22, 24 are pulled to the right out of slot 110 so that the cords 22, 24 are free to move within the opening 108 to adjust the window covering 10 to the desired position.

Figure 12:
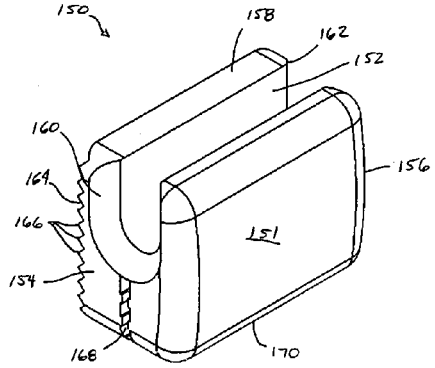
FIG. 12 is a top left isometric view of an alternative embodiment of a combination cord guide and cord lock.

FIGS. 12-15 illustrate a further alternative embodiment of a combined cord guide and cord lock 150. Referring to FIG. 12, which is a perspective view of the combined cord guide and cord lock 150, the combined cord guide and cord lock 150 is fabricated from a block of material 151 that may be similar to the block of material 102 previously described for the combined cord guide and cord lock 100. The combined cord guide and cord lock 150 has a channel 152 passing through the block of material 151 from a first or left side 154 and a second or right side 156 disposed on opposite sides of the block of material 151. The channel 152 may be a throughbore, similar to the throughbore 104 of the combined cord guide and cord lock 100, or may extend upwardly through a third or top side 158 of the block of material 151 disposed above the left and right sides 154, 156 whereby one or more of the cords 22, 24 may be disposed into or removed form the channel 152 by passing through the open end of the channel 152 through the top side 158. The channel 152 is dimensioned to receive a plurality of cords 22, 24, with the width of the channel 152 being at least larger than the diameter of the cords 22, 24 to allow the cords 22, 24 to slide freely within the channel 152 when the cords 22, 24 are disposed therein. The channel 152 may also include countersunk surfaces 160, 162 angled inwardly from the left and right sides 154, 156, respectively, toward the channel 152, and similar countersunk surfaces (not shown) angled inwardly from the top side 158, to thereby funnel the cords 22, 24 into the channel 152.

A fourth or rear side 164 of the block 151 may be attached to the headrail 13 and/or topmost pleat 38 of the window covering 10 in manner as previously described, and may have a non-planar surface providing greater surface area to be covered by an adhesive and, consequently, increase the hold force securing the combined cord guide and cord lock 150 to the window covering 10. For example, the non-planar surface of the rear side 164 may define a plurality of horizontal ridges or teeth 166 extending across the width of the rear side 164. It is contemplated that the rear side 164 may have other non-planar configurations providing greater surface area than a planar surface such as, for example, square or rounded grooves, pits, holes, dimples or other shapes or patterns in an otherwise generally planar surface, and the like.

Figure 13:
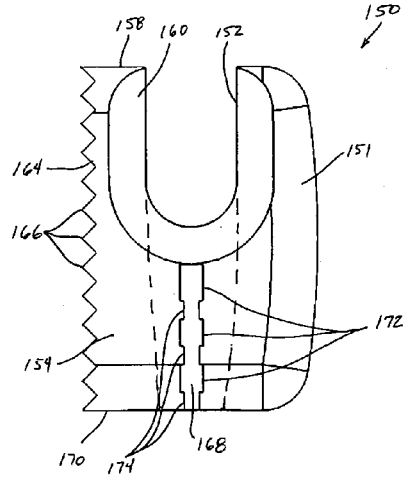
FIG. 13 is a side view of the combination cord guide and cord lock of FIG. 12.

The combined cord guide and cord lock 150 further includes a slot 168 through the block 151 and extending upwardly into the block 151 from a fifth or bottom surface 170 and terminating within the block 151 below the channel 152. The slot 168 extends inward through the surface of the left side 154 below the channel 152 and countersunk surface 160, passes through the block 151 toward the right side 156 and intersects a throughbore (FIGS. 14 and 15) in a similar manner as the slots 48 and 110 intersect the countersunk openings 46 and 108, respectively. Referring to FIG. 13, which is a left side view of the combined cord guide and cord lock 150, the slot 168 include alternating wide portions 172 and narrow portions 174 for retentively engaging the cords 22, 24 when the cords 22, 24 are disposed therein to maintain the window covering 10 in a desired position. The width of the narrow portions 174 may by smaller than the diameter of the each of the cords 22, 24 so that the inner surfaces of the slot 168 at the narrow portions 714 engage the cords 22, 24 disposed therein to prevent the cords 22, 24 from dropping out of the slot 168, and to retain the cords 22, 24 within the slot 168 against the combined weight of the bottom rail 25 and accumulated portion of the pleated cover 12. The width of the wide portions 172 may be larger than the width of the narrow portions 174, with the inner surface of the slot 168 at the wide portions 172 engaging the cords 22, 24 with a lesser amount of force that may still be sufficient to retain the cords 22, 24 within the slot 168 against the combined weight of the bottom rail 25 and accumulated portion of the pleated cover 12.

Figure 14:
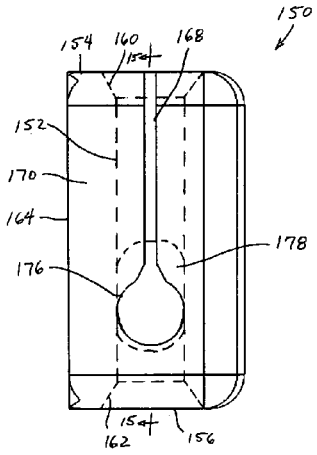
FIG. 14 is a bottom view of the combination cord guide and cord lock of FIG. 12.

Referring to the bottom view of the combined cord guide and cord lock 150 shown in FIG. 14, the combined cord guide and cord lock 150 includes an opening 176 in the bottom side 170 of the block 151 for a throughbore 178 extending upwardly into the block 151 and intersecting the channel 152 and thereby forming a passage from the bottom side 170 to the channel 152. As previously discussed, the slot 168 extends inwardly from the left side 154 and intersects the throughbore 178 such that the cords 22, 24 may be pulled into the slot 168 when the cords 22, 24 are disposed in the throughbore 178 and through the opening 176, and engaged by the inner surfaces of the slot 168 to lock the window covering 10 in a desired position against the combined weight of the bottom rail 25 and accumulated pleated cover 12.

Figure 15:
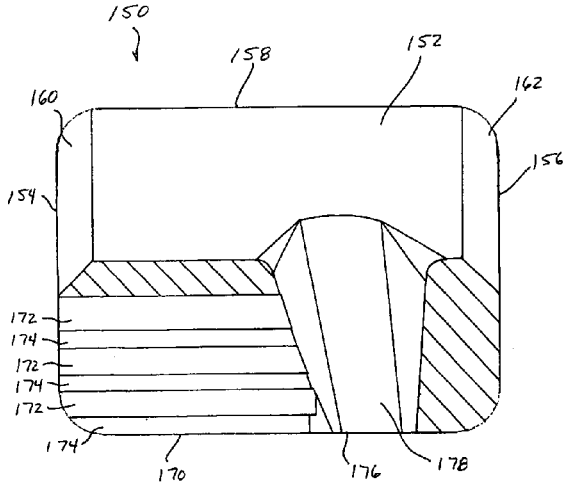
FIG. 15 is a front cross-sectional view through line 15-15 of the combination cord guide and cord lock of FIG. 12.

As with the combined cord guide and cord lock 100, the combined cord guide and cord lock 150 may be similarly used for both the cord guides 26, 28 and the cord lock 30 of the window covering 10. Referring to FIG. 15, which is a cross-sectional view of the combined cord guide and cord lock 150, the combined cord guide and cord lock 100 may be implemented as the cord guide 28 by threading the upper end of the cord 24 through the opening 176 and throughbore 178, into the channel 152 and rightward past the countersunk surface 162 and right side 156 toward the cord lock 30. With the cord 24 disposed on the right side of the opening 176 and throughbore 178, the cord 24 is not engaged by the slot 168 and, consequently, is free to pass through the opening 176, throughbore 178 and channel 152 as the window covering 10 is raised and lowered.

In a similar manner as shown in FIG. 10, the cord 22 may also pass through the channel 152 from the left side 154 to the right side 156 toward the cord lock 30. Implemented as the cord guide 30, the upper ends of the cords 22, 24 may enter the channel 152 of the combined cord guide and cord lock 150 at the left side 154 and pass downwardly through the throughbore 178 and opening 176. The cords 22, 24 and, consequently the window covering 10, may be locked in position by pulling the portions of the cords 22, 24 disposed within the throughbore 178 into the slot 168 wherein the cords 22, 24 are engaged by inner surfaces of the slot 168. Each cord 22, 24 may be disposed entirely within one of the wide portions 172 or narrow portions 174, or extend across a plurality of the portions 172, 174. In order to reposition the window covering 10, the free ends of the cords 22, 24 are pulled downwardly and/or to the right out of the slot 168 so that the cords 22, 24 are free to move within the opening 176 and throughbore 178 to adjust the window covering 10 to the desired position. While the window covering 10 and combined cord guide and cord locks 40, 100 and 150 are illustrated and described herein as being configured with the cord locks 30 disposed to the right of the cord guides 26, 28, those skilled in the art will understand that combined cord guide and cord locks 40, 100 and 150 may reconfigured with their respective slots disposed to the right of the openings and/or throughbores so that the cord lock 30 may be positioned to the left of the cord guides 26, 28 on the window covering 10.

Figure 17:
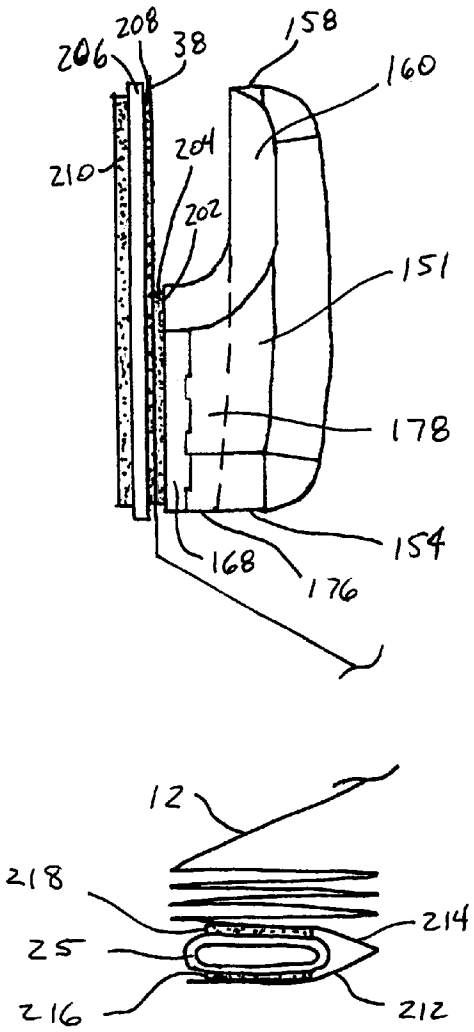
FIG. 17 is a side view of the combination cord guide and cord lock of FIG. 16 attached to the pleated cover of a temporary window covering.
Figure 16:
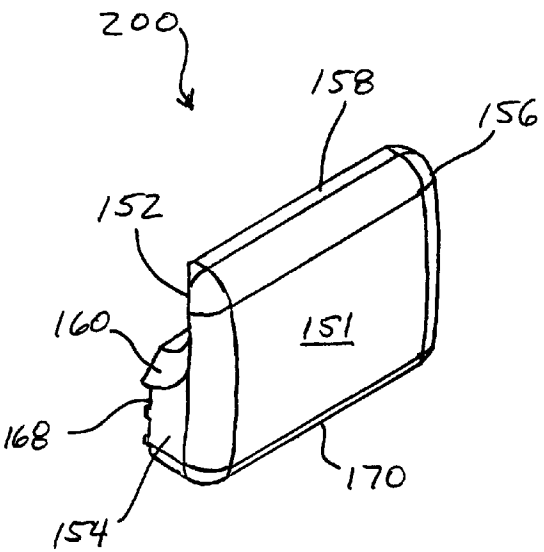
FIG. 16 is a top left isometric view of a further alternative embodiment of a combination cord guide and cord lock.

Referring to FIGS. 16 and 17, an alternative embodiment of a combined cord guide and cord lock 200 may be configured in a similar manner as, for example, the combined cord guide and cord lock 150 having a rear portion of the block 151 removed such that the portion of the window covering 10 to which the combined cord guide and cord lock 200 is attached partially defines the channel 152, slot 168, opening 176 and/or the throughbore 178. As shown in FIG. 16, in one embodiment, the combined cord guide and cord lock 200 may resemble the combined cord guide and cord lock 150 having a portion of the block 151 from the rear side 164 to the channel 152 and slot 168 removed such that the channel 152, slot 168 and throughbore 178 (not shown) are partially defined by the block 151. When the combined cord guide and cord lock 200 is attached to the window covering, such as directly to the topmost pleat 38 as illustrated in FIG. 17, the topmost pleat 38 and the portion of the channel 152 defined by the block 151 define the channel 152 in which the cords 22, 24 may be slidably disposed. Similarly, the topmost pleat 38 and the portions of the slot 168, opening 176 and throughbore 178 defined by the block 151 define the slot 168 that may retentively engage the cords 22, 24 when disposed therein, and the opening 176 and throughbore 178 in which the cords 22, 24 may be slidably disposed.

As previously mentioned, FIG. 17 illustrates an embodiment of the temporary window covering 10 wherein the combined cord guide and cord locks 40, 100, 150 and 200 may be directly attached to the topmost pleat 38 of the pleated cover 12. In the illustrated embodiment, the topmost pleat 38 is connected to a rear side 202 of the combined cord guide and cord lock 200 by an adhesive layer 204, which may be glue, epoxy or other adhesive, two-way tape, or other desired attachment mechanism. In order to provide sufficient strength for the topmost pleat 38 to support the combined cord guide and cord lock 200, a reinforcement member 206 is attached to the surface of the topmost pleat 38 opposite the combined cord guide and cord lock 200 by a second adhesive layer 208. Where used, the reinforcement member 206 may be dimensioned and positioned to reinforce one of the cord guides 26, 28 or cord lock 30, or my extend the width of the window covering 10 ad reinforce the entire topmost pleat 38 and/or headrail 13 to which the reinforcement member 206 may be attached. At the outermost surface opposite the combined cord guide and cord lock 200, which may be the topmost pleat 38, reinforcement member 206, or a combination thereof, an additional adhesive layer 210 may be disposed such that the adhesive layer 210 may attach the window covering 10 to a window frame or other support structure defining an opening to be covered by the window covering 10. FIG. 17 further illustrates that the bottom rail 25 may be attached to one or more of the bottommost pleats 212, 214 by adhesive layers 216, 218, respectively.

Figure 18:
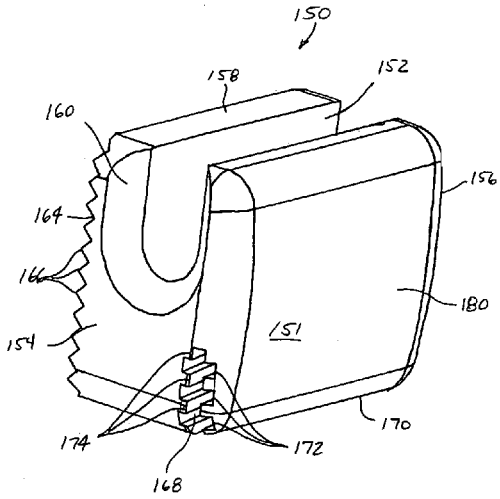
FIG. 18 is a top left isometric view of an alternative embodiment of the combination cord guide and cord lock of FIG. 12.
Figure 19:
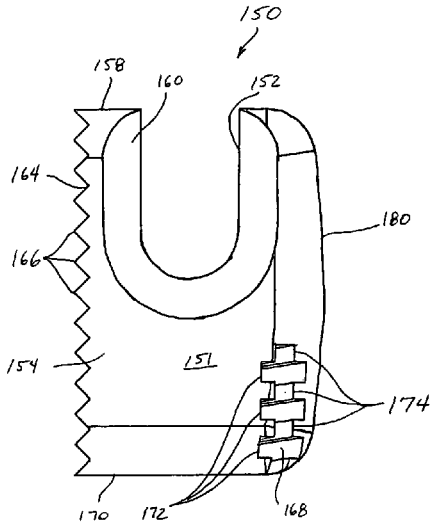
FIG. 19 is a side view of the combination cord guide and cord lock of FIG. 18.
Figure 20:
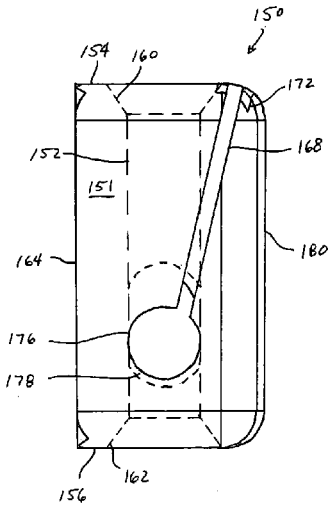
FIG. 20 is a bottom view of the combination cord guide and cord lock of FIG. 18.
Figure 21:
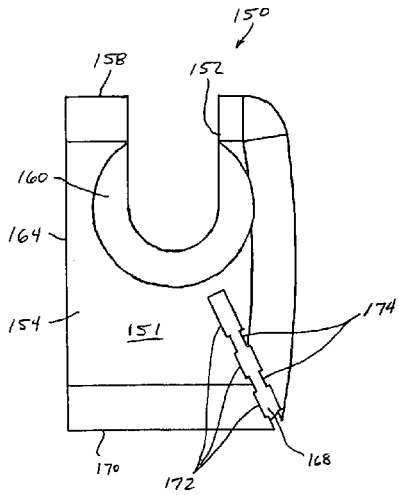
FIG. 21 is a side view of a further alternative embodiment of the combination cord guide and cord lock of FIG. 12.

FIGS. 18-20 illustrate a further alternative embodiment of the combined cord guide and cord lock 150 wherein the slot 168 is oriented at an angle with respect to the rear side 164. As in the previous embodiment, the slot 168 extends upwardly from the bottom side 170 toward the channel 152, as shown in FIGS. 18 and 19. Referring to the bottom view of FIG. 20, the slot 168 intersects the opening 176 and throughbore 178 and extends toward the left side 154 of the block 151 with the distance of the slot 168 to the rear side 164 increasing and, correspondingly, with the distance of the slot 168 to a front side 180 of the block 151 decreasing, as the slot 168 extends toward the left side 154. In a still further alternative embodiment illustrated in FIG. 21, the slot 168 may be further oriented such that the slot 168 increases in distance from the rear side 164 of the block 151 as the slot 168 extends downwardly from the channel 152 toward the bottom side 170. Configured as shown in FIGS. 18-21 with the opening of the slot 168 disposed opposite the rear side 164, and consequently farther from the mounting surface to which the window covering 10 is attached, the combined cord guide and cord lock 200 provides greater clearance for manipulating the cords 22, 24 to be disposed into and removed from the slot 168 to lock and unlock the window covering 10.

Figure 22:
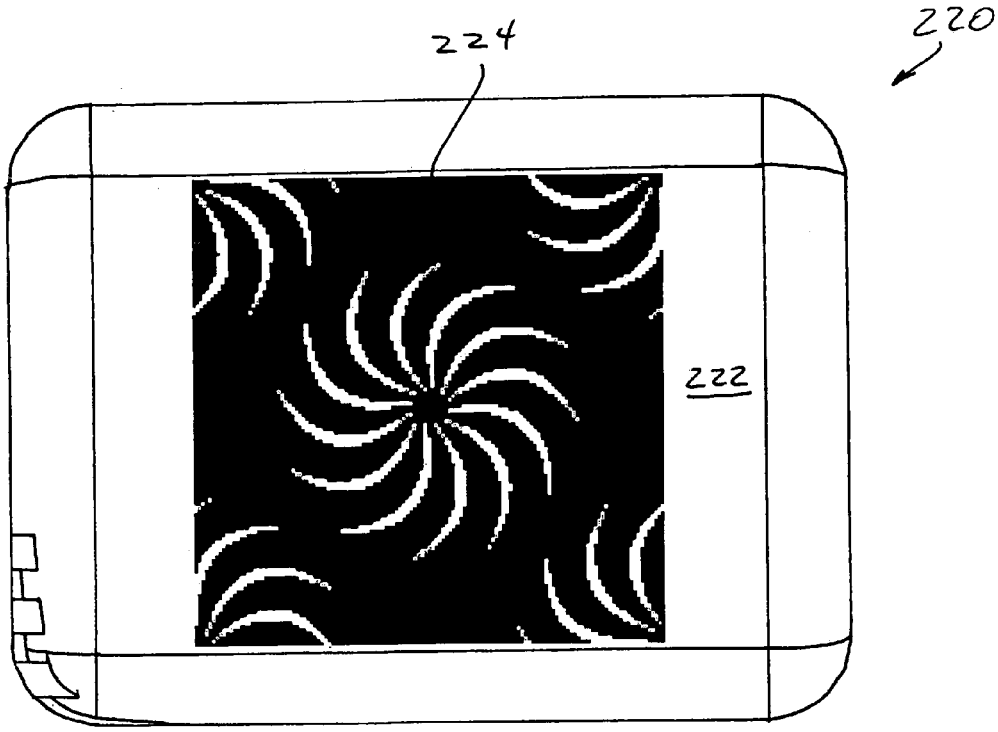
FIG. 22 is a front view of another alternative embodiment of a combination cord guide and cord lock.

A further alternative embodiment of a combined cord guide and cord lock 220 is illustrated in FIG. 22. It may be desirable to provide a more aesthetically pleasing appearance to the temporary window covering 10. In such implementations of window coverings 10, the front side 222 of the combined cord guide and cord lock 220 may include a decorative design 224 disposed thereon. The design 224 may be applied in any desired manner. For example, the design 224 may be molded or fabricated into the surface of the front side 222 at the time the combined cord guide and cord lock 220 is manufactured, such as in a molding, etching or embossment process. Alternatively, the design 224 may be applied to the front side 222 after the manufacturing process, such as by painting the design 224 on the front side 222, applying a sticker or decal, attaching a sculpted or molded figure to the surface of the front side 222, or by any other desired process for applying the design 224 to the combined cord guide and cord lock 220.

Figure 23:
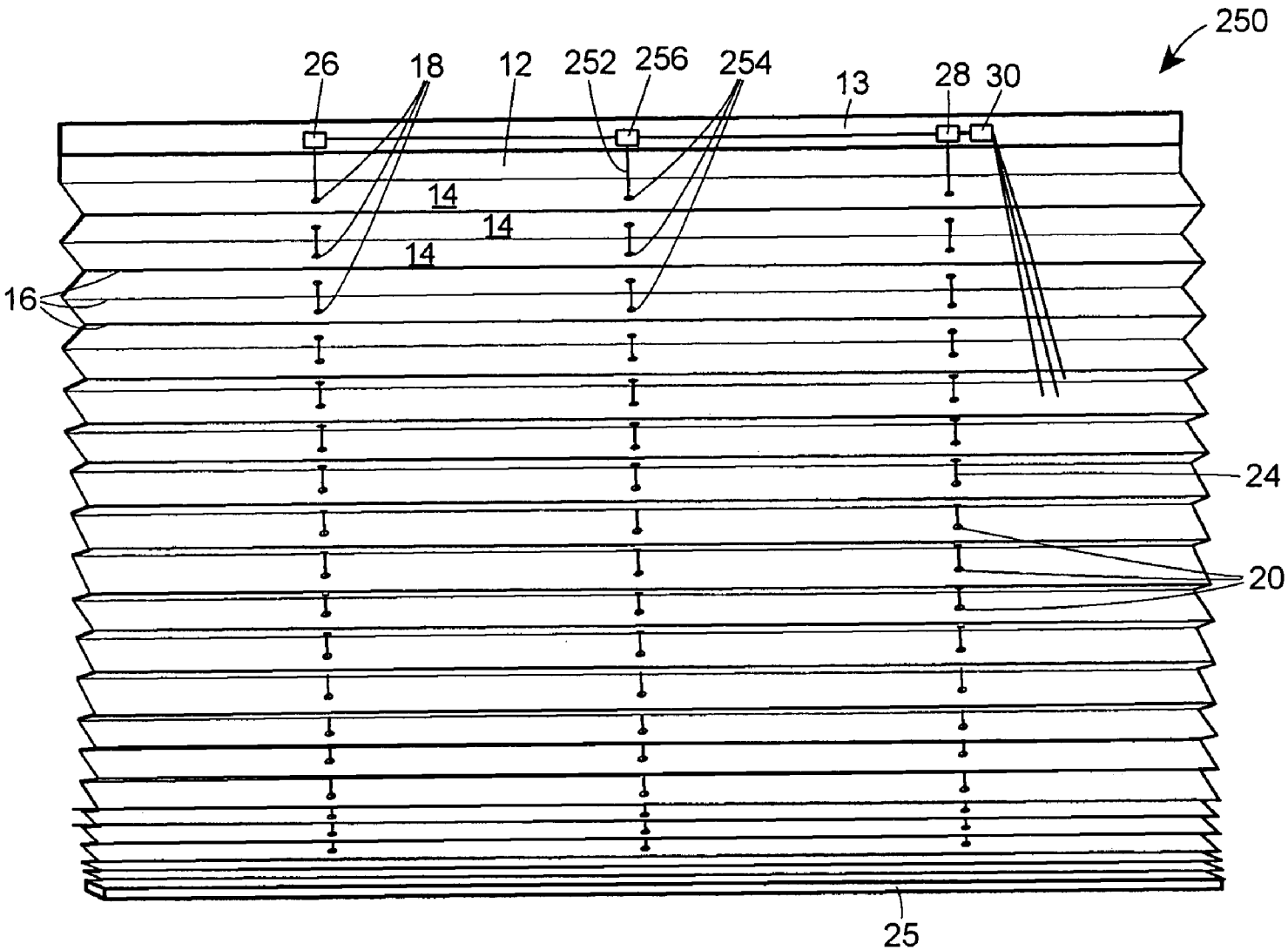
FIG. 23 is a front view of an alternative embodiment of a temporary window covering.

While the temporary window covering 10 has been described herein as having a pair of cords 22, 24, with the cord lock 30 engaging and retaining the cords 22, 24, it is contemplated that the temporary window covering 10 may be implemented with a single cord, or may be implemented with more than two cords, depending on the design requirements, market forces, preferences and the like. For example, it may be desired to offer a single size temporary window covering 10 that may be cut down to size by the customer after it is purchased to fit and cover a particular opening. For example, an embodiment of a temporary window covering 250 that may be purchased by a customer and cut down to size to fit a particular opening is shown in FIG. 23, wherein similar elements as those described for the temporary window covering 10 are identified with the same reference numerals. The temporary window covering 250 may be substantially wider than the temporary window covering 10 in order to accommodate wider windows or openings. Consequently, the pleated cover 12 will be proportionately heavier and may require at least one additional cord 252 to support the additional weight. The cord 252 may be disposed between the cords 22, 24, may be connected to the bottom rail 25, and may pass upwardly through corresponding holes 254 in the pleats 14 of the pleated cover 12. The window covering 250 may further included an addition cord guide 256 for the cord 252 connected to the headrail 13 between the cord guides 26, 28.

The cord 252 passes upwardly through the cord guide 256 and rightward through the cord guide 28 to the cord lock 30. In order to position the window covering the cords 22, 24 and 252 may be pulled into and engaged by the slot of the cord lock 30 to lock the bottom rail 25 in position. In order to facilitate resizing the window covering 250, the cords 22, 24 and corresponding cord guides 26, 28 may be positioned sufficiently inwardly from the edges of the pleated cover 12 so that a desired amount of the outward portions of the pleated cover 12 may be removed to resize the blind the desired width. Additionally, the cord lock 30 may be positioned in close proximity to the cord guide 28 to maximize the portion of the pleated cover 12 that may be removed. When the pleated cover 12 is cut down to size, it may also be necessary to cut down the bottom rail 25 by a corresponding amount to fit the opening.

Figure 24:
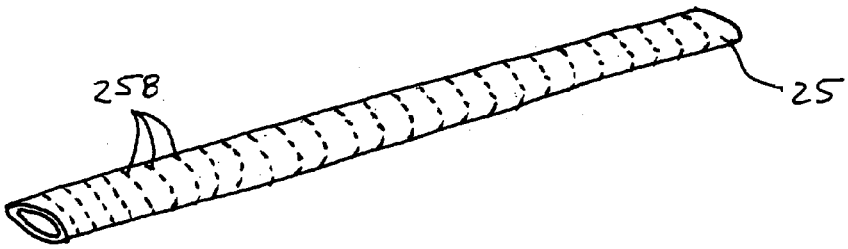
FIG. 24 is a perspective view of an embodiment of a bottom rail for a temporary window covering.

FIG. 24 illustrates an embodiment of the bottom rail 25 adapted to be cut down to a desired with. The bottom rail 25 may be in the form of an elongated tube fabricated from plastic or other material that is light enough to be supported by the adhesive or other mechanism attaching the window covering 250 to the opening, and strong enough to support the weight of the accumulated pleated cover 12. The bottom rail 25 may be adapted for resizing by having portions 258 and incremental distances along the bottom rail 25 having reduced strength such that the bottom rail 25 may be subdivided by the purchaser at the portions 258. The strength of the portions may be reduced in any appropriate manner, such as by scoring the surface or embossing indentations or perforations in the surface of the bottom rail 25 at the portions 258, fabricating the walls of the bottom rail 25 with a smaller thickness at the portions 258, or by any other desired method. In order to resize the bottom rail 25, the purchaser may separate a desire length of the bottom rail 25 from the remainder of the bottom rail 25 at the desired portion 258 such that the resized bottom rail 25 corresponds to the resized pleated cover 12.

What is claimed is:

1. A temporary window covering comprising:

a pleated cover formed from a sheet of material having a top edge, a bottom edge and a plurality of horizontal creases extending across the width of the sheet thereby defining a plurality of pleats, each pleat having a first hole therethrough with the first holes being substantially aligned from the bottom edge to the top edge, the pleated cover being adapted to be oriented in a retracted position wherein each of the pleats is substantially horizontally aligned and in contact with the adjacent pleats, an extended position wherein each of the pleats is substantially vertical and substantially vertically aligned with the other pleats, and a plurality of intermediate positions wherein at least some of the pleats are oriented between the pleats' retracted positions and the pleats' extended positions;

a bottom rail attached to a bottommost pleat of the pleated cover;

a first lift cord having a first end connected to the bottom rail, the first lift cord being threaded through the first holes of the pleats of the pleated cover;

a first cord guide coupled to the pleated cover proximate the top edge and proximate the first holes, the first cord guide having a first throughbore and a slot intersecting the first throughbore, the first throughbore of the first cord guide being configured to slidably engage the first lift cord when the first lift cord is disposed therein, and the slot of the first cord guide being configured to retentively engage the first lift cord to support the weight of the bottom rail and an accumulated portion of the pleated cover when the first lift cord is disposed therein; and a cord lock coupled to the pleated cover proximate the top edge and having a first throughbore and a slot intersecting the first throughbore, the first throughbore of the cord lock slidably engaging the first lift cord when the first lift cord is disposed therein, and the slot of the cord lock retentively engaging the first lift cord to support the weight of the bottom rail and an accumulated portion of the pleated cover when the first lift cord is disposed therein, wherein the first lift cord is thread through the first holes of the pleats of the pleated cover, through the first throughbore of the first cord guide, and through the first throughbore of the cord lock, the temporary window covering being adapted to be repositioned from a first one of the retracted position, the extended position and an intermediate position to a second one of the retracted position, the extended position and an intermediate position by moving a first portion of the first lift cord disposed in the slot of the cord lock to the first throughbore of the cord lock, sliding the first lift cord through the first throughbore of the first cord guide and the first throughbore of the cord lock, and moving a second portion of the first lift cord disposed in the first throughbore of the cord lock to the slot of the cord lock.

2. A temporary window covering as recited in claim 1, wherein the bottom rail comprises an elongated tube having a plurality of incrementally spaced weakened portions whereat the portions of the elongated tube on either side of a given weakened portion are separable from each other.

3. A temporary window covering as recited in claim 1, wherein each pleat of the pleated cover has a second hole therethrough with the second holes being substantially aligned from the bottom edge to the top edge, the temporary window covering comprising:

a second lift cord having a first end connected to the bottom rail, the second lift cord being threaded through the first holes of the pleats of the pleated cover; and a second cord guide coupled to the pleated cover proximate the top edge and proximate the second holes, the second cord guide having a first throughbore and a slot intersecting the first throughbore, the first throughbore of the second cord guide being configured to slidably engage the second lift cord when the second lift cord is disposed therein, and the slot of the second cord guide being configured to retentively engage the second lift cord to support the weight of the bottom rail and an accumulated portion of the pleated cover when the second lift cord is disposed therein, wherein the throughbore of the cord lock slidably engages the first and second lift cords when the first and second lift cords are disposed therein, and the slot of the cord lock retentively engages the first and second lift cords to support the weight of the bottom rail and an accumulated portion of the pleated cover when the first and second lift cords are disposed therein, wherein the second lift cord is thread through the second holes of the pleats of the pleated cover, through the throughbore of the second cord guide, and through the throughbore of the cord lock, the temporary window covering being adapted to be repositioned from a first one of the retracted position, the extended position and an intermediate position to a second one of the retracted position, the extended position and an intermediate position by moving first portions of the first and second lift cords disposed in the slot of the cord lock to the throughbore of the cord lock, sliding the first and second lift cords through the throughbores of the first and second cord guides, respectively, and the throughbore of the cord lock, and moving second portions of the first and second lift cords disposed in the throughbore of the cord lock to the slot of the cord lock.

4. A temporary window covering as recited in claim 3, wherein the first cord guide has a second throughbore, the first throughbore of the first cord guide intersects the second throughbore of the first cord guide, the first lift cord is threaded through the first throughbore and a portion of the second throughbore of the first cord guide, and the second lift cord is threaded through the second throughbore of the first cord guide, wherein the second cord guide has a second throughbore, the first throughbore of the second cord guide intersects the second throughbore of the second cord guide, and the second lift cord is threaded through the first throughbore and a portion of the second throughbore of the second cord guide, and wherein the cord lock has a second throughbore, the first throughbore of the cord lock intersects the second throughbore of the cord lock, and the first and second lift cords are threaded through a portion of the second throughbore and the first throughbore of the cord lock.

5. A temporary window covering as recited in claim 3, wherein the first cord guide has a channel, the first throughbore of the first cord guide intersects the channel of the first cord guide, the first lift cord is threaded through the first throughbore and disposed in a portion of the channel of the first cord guide, and the second lift cord is disposed in the channel of the first cord guide, wherein the second cord guide has a channel, the first throughbore of the second cord guide intersects the channel of the second cord guide, and the second lift cord is threaded through the first throughbore and a portion of the channel of the second cord guide, and wherein the cord lock has a channel, the first throughbore of the cord lock intersects the channel of the cord lock, and the first and second lift cords are disposed in a portion of the channel and threaded through the first throughbore of the cord lock.

6. A temporary window covering as recited in claim 1, wherein the slot of the first cord guide is oriented at an angle relative to a surface of the pleated cover to which the first cord guide is coupled whereby the distance between the slot of the first cord guide and the pleated cover increases as the slot of the first cord guide proceeds from a portion of the slot proximate the first throughbore of the first cord guide toward a portion of the slot distal to the first throughbore of the first cord guide, and wherein the slot of the cord lock is oriented at an angle relative to a surface of the pleated cover to which the cord lock is coupled whereby the distance between the slot of the cord lock and the pleated cover increases as the slot of the cord lock proceeds from a portion of the slot proximate the first throughbore of the cord lock toward a portion of the slot distal to the first throughbore of the cord lock.

7. A temporary window covering as recited in claim 1, wherein the slot of the first cord guide is oriented at an angle relative to a surface of the pleated cover to which the first cord guide is coupled whereby the distance between the slot of the first cord guide and the pleated cover increases as the slot of the first cord guide proceeds downwardly from a portion of the slot proximate the top edge of the pleated cover toward the bottom edge of the pleated cover, and wherein the slot of the cord lock is oriented at an angle relative to a surface of the pleated cover to which the cord lock is coupled whereby the distance between the slot of the cord lock and the pleated cover increases as the slot of the cord lock proceeds downwardly from a portion of the slot proximate the top edge of the pleated cover toward the bottom edge of the pleated cover.

8. A temporary window covering as recited in claim 1, wherein the slot of the first cord guide has at least one narrow portion and at least one wide portion wherein the inner surfaces of the slot at the narrow portion engages the first lift cord with greater force than the inner surfaces of the slot at the wide portion, and wherein the slot of the cord lock has at least one narrow portion and at least one wide portion wherein the inner surfaces of the slot at the narrow portion engages the first lift cord with greater force than the inner surfaces of the slot at the wide portion.

9. A temporary window covering as recited in claim 1, wherein at least one of the first throughbore and the slot of the first cord guide is partially defined by the first cord guide and partially defined by a surface of the pleated cover to which the first cord guide is coupled, and wherein at least one of the first throughbore and the slot of the cord lock is partially defined by the cord lock and partially defined by a surface of the pleated cover to which the cord lock is coupled.

10. A temporary window covering as recited in claim 1, comprising a reinforcement member coupled to a surface of the pleated cover opposite a surface of the pleated cover to which the cord lock is coupled.

11. A temporary window covering as recited in claim 1, comprising an adhesive layer disposed on a surface of the pleated cover opposite a surface of the pleated cover to which the first cord guide and the cord lock are coupled.

12. A temporary window covering as recited in claim 1, wherein the pleated cover has a topmost pleat at the top edge, the temporary window covering comprising a headrail coupled to the topmost pleat of the pleated cover, and wherein the first cord guide and the cord lock are coupled to the headrail.

13. A temporary window covering as recited in claim 1, wherein the first cord guide and the cord lock are geometrically identical.

14. A combined cord guide and cord lock for a temporary window shade having a pleated cover, a bottom rail coupled to the pleated cover proximate a bottom edge of the pleated cover, and at least one lift cord connect to the bottom rail, the combined cord guide and cord lock comprising:

a body member having an outer surface comprising a first side, a second side, a third side and a fourth side disposed perpendicular to the third side;

a first inner surface of the body member intersecting the outer surface of the body member and defining a channel within the body member, the first inner surface configured to slidably engage at least one lift cord of the temporary window covering disposed therein, and wherein the first inner surface intersects the first side and the second side and defines the channel therebetween;

a second inner surface of the body member intersecting the third side of the outer surface and the first inner surface and defining a throughbore within the body member between the third side and the first inner surface, the second inner surface configured to slidably engage at least one lift cord of the temporary window covering disposed therein; and a third inner surface of the body member intersecting a second portion of the outer surface and the second inner surface and defining a slot within the body member, the third inner surface configured to retentively engage at least one lift cord of the temporary window covering disposed therein to support the weight of the bottom rail and an accumulated portion of the pleated cover of the temporary window shade, and wherein the distance between the slot defined by the third inner surface and the fourth side increases as third inner surface proceeds from a portion proximate the intersection of the second inner surface and the third inner surface toward a portion of the third inner surface distal to the intersection of the second inner surface and the third inner surface.

* * * * *